United States Patent [19]

Merry

[11] 4,154,428

[45] May 15, 1979

[54] ADJUSTABLE ROLLER CHOCK

[75] Inventor: Carl A. Merry, Marion, Mass.

[73] Assignee: Schaefer Marine Products, New Bedford, Mass.

[21] Appl. No.: 840,994

[22] Filed: Oct. 11, 1977

[51] Int. Cl.[2] ..... B66D 1/36

[52] U.S. Cl. ..... 254/190 R; 114/218; 403/381

[58] Field of Search ..... 254/193, 192, 194, 195, 254/196, 190 R, 183; 114/218, 102, 108; 104/248; 160/344, 345; 248/295, 200; 242/157 R; 403/381

[56] References Cited

U.S. PATENT DOCUMENTS

| | | | |
|---|---|---|---|
| 85,845 | 1/1869 | Thayne | 254/190 R |
| 1,010,108 | 11/1911 | Ashworth | 114/218 |
| 2,336,044 | 12/1943 | Stuart | 403/381 |
| 2,464,451 | 3/1949 | Keeney | 254/194 |
| 2,919,110 | 12/1959 | Magee | 254/193 |
| 2,949,271 | 8/1960 | Kraus, Jr. et al. | 254/190 R |

*Primary Examiner*—Trygve M. Blix
*Assistant Examiner*—Kenneth W. Noland
*Attorney, Agent, or Firm*—Cesari and McKenna

[57] ABSTRACT

An adjustable roller chock characterized by a strong, non-fraying strap structure and particularly by a smooth strap formed of a partially flattened tubular member.

3 Claims, 3 Drawing Figures

ADJUSTABLE ROLLER CHOCK

BACKGROUND OF THE INVENTION

This invention relates to an improved roller chock.

Rope and cable fastening devices of the type called roller chocks are used in a number of applications on sailing craft. For example, they may be used to position spring lines to facilitate mooring the boat. Such chocks usually include a pair of rollers spaced apart from one another and secured to a base. The line from the mooring is passed between the rollers and made fast to a deck cleat mounted adjacent to the chock.

In many cases, the prior chocks are open at the top, consequently when the boat is underway sheets and halyards can become caught in the chocks causing inconveneince, particularly when the boat is being raced.

There are some prior roller chocks whose tops are closed to prevent the aforesaid problem.

In such cases, the closure is invariably in the form of a strap. In the past there has been a problem in providing such a strap which is suitably inexpensive, suitably light in weight, and also sufficiently strong to resist the high, rapidly varying stresses that can be exerted on the chock as a whole, as when a boat heaves at its mooring. Moreover, while all the above attributes are desirable, they should be achieved while subjecting a line passing through the roller chock to the other chock to as little abrasion or chafing as is possible.

In some sailing craft, it is often important to have a variable positioning capability for some chocks. For example, when the chock is used with a spring line for mooring purposes, it is desirable that it be positioned at a location along the boat that will cause the boat to pivot about the correct point into its allotted space at the mooring. To this end, there have been provided roller chocks which are suitable for mounting on elongated tracks. Such chocks are provided with a slider member which holds the chock upon its track while it is moved along the track. When the chock is in the desired position, a set screw on the slider is tightened to hold the chock against the track in that position. Conventional adjustable chocks of the type that ride in tracks, have a body connected to the slider by primary screws extending through the chock rollers, into the slider. Consequently, bending moments applied to the rollers are borne to a substantial extent by the screws. This can result in the bending of the screws and the damage to the screw threads wich makes it difficult to remove the screws and to visually ascertain whether the screws were properly tightened, etc.

Thus, there has been a need in the art to provide an improved non-chafing roller chock and, also, an improved roller chock of the type that can be adjustably positioned on a track.

SUMMARY OF THE INVENTION

Thus, it is an object of the invention to provide an improved rope retaining device such as a roller chock.

Another object of the invention is to provide an improved roller chock whose top is closed by a restraining strap which is non-chafing, yet is of high strength and is easily constructed.

Another object of the invention is to provide an adjustable roller chock which is adapted for movement with a slider member along a track.

Another object of the invention is to provide a chock whose roller fasteners are protected from unnecessary stress.

Other objects of the invention will be obvious to those skilled in the art upon reading this disclosure.

The above objects have been substantially achieved by constructing a roller chock which has a restraining strap formed of partially flattened rigid tubing. The exterior surface of the deformed tubing provides an ideal smooth, non-chafing surface, while the physical form of the strap provides a chock closure having an excellent strength-to-weight ratio.

In the more advantageous embodiments of the invention, the tubular closure strap and the chock rollers are engaged on strong, rigid, internally threaded sleeves welded to, and projecting upwardly from, the slider member. Threaded fasteners extend down through the strap ends of the rollers into the sleeves thereby anchoring the strap and rollers to the slider, while permitting the rollers to rotate on the sleeves. Thus, most of the force exerted on the chock strap and rollers are transmitted to the slider by way of the sleeves rather than via its fasteners so that excessive forces on the threaded fasteners are avoided.

The strap itself is partially flattened so that it is more or less pillow-shaped in the region between the rollers so that it presents a very smooth, non-chafing surface to lines passing through the chock. At the same time, the tubular nature of the strap makes it extremely resistant to bending forces that often arise when a line retained by the chock is pulled upwardly relative to the chock. Thus, the present roller chock provides a very strong, movable, chafe-free retainer for lines on a boat.

BRIEF DESCRIPTION OF THE DRAWING

In this application and accompanying drawing there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

SPECIFIC DESCRIPTION

Figure 1:
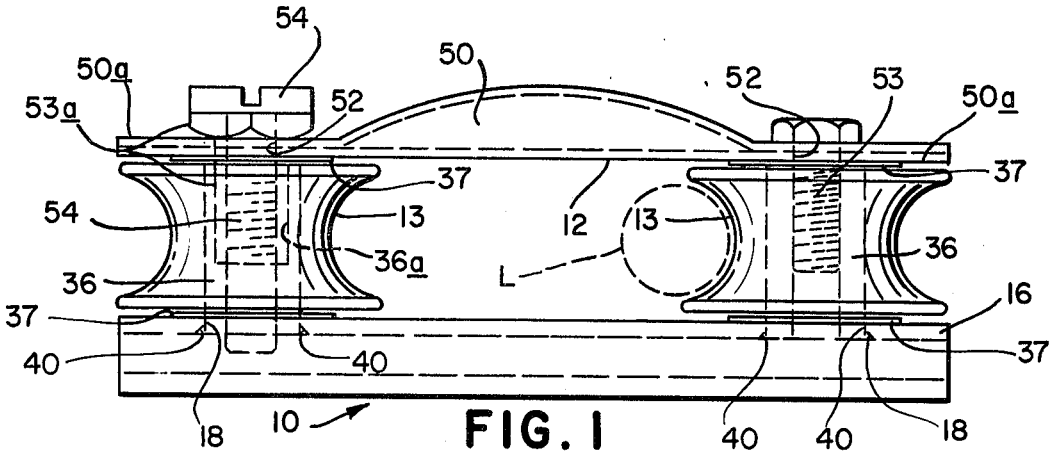
FIG. 1 is a side elevation, partially in section, of an adjustable roller chock constructed according to the invention.

Referring to FIG. 1, the adjustable roller chock 10 comprises a strap member 12 mounted along with two rollers 13 on a C-shaped slider member 16. More particularly, the slider is formed with a pair of apertures 18 near its opposite ends which receive the ends of a pair of strong, rigid, internally threaded sleeves 36. The sleeves' lower ends are anchored to the slider by circumferential welds 40 at the junctions of the sleeves 36 and slider 16.

Rollers 13 are rotatively received on the sleeves, with the sleeves extending up from the slider and projecting slightly from the tops of the rollers. Thin washers 37 made of polytetrafluoroethylene are positioned on the sleeves above and below the rollers to assure that the rollers can rotate freely.

Figure 2:
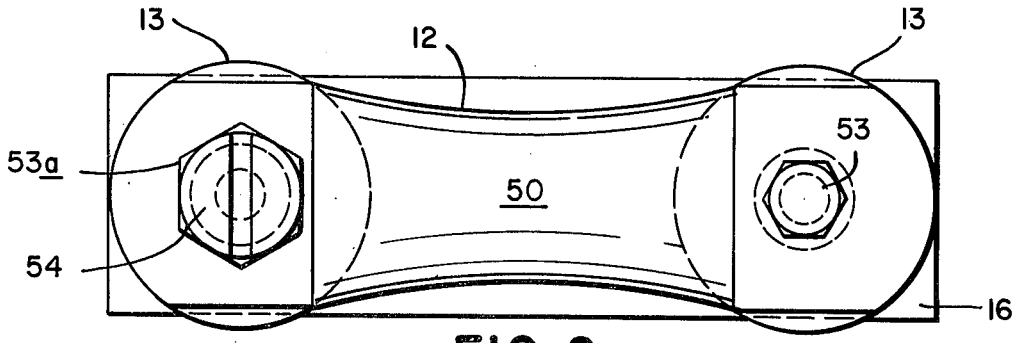
FIG. 2 is a plan view of the chock of FIG. 1.

As best seen in FIGS. 1 and 2, strap 12 is tubular having a mid-position 50 that is partially flattened making it pillow-shaped. The opposite ends 50*a* of the strap, on the other hand, are completely flattened forming laminates. The strap ends 50*a* have apertures 52 positioned directly above sleeves 36 for receiving fasteners 53 and 53*a*.

Fastener 53 is simply a bolt that is turned down into its sleeve 36 thereby retaining the right end (FIG. 1) of the strap and the underlying roller on sleeve 36. Fastener 53*a*, on the other hand, is in the form of a tubular internally and externally threaded bushing that is received in a threaded counter bore 36*a* in the left hand sleeve 36.

Figure 3:
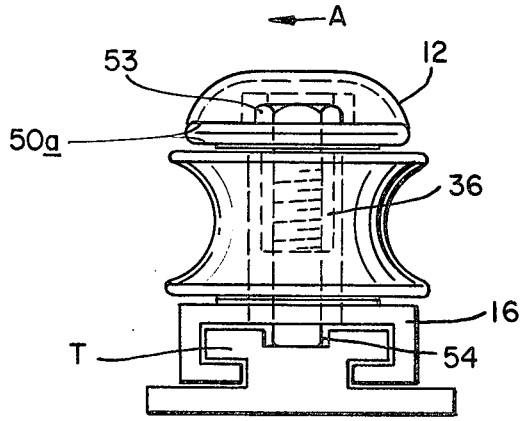
FIG. 3 is a right end elevation of the roller chock of FIG. 1 whown adjustably mounted on a track.

As best seen in FIG. 3, chock 10 is normally slidably mounted on a track T with slider 16 engaging under the track rails. In order to retain the chock at a selected location along the track a set screw 54 is provided which can be turned down into the internally threaded bushing 53*a* until its lower end engages the top of track T as shown in FIG. 3.

In using the chock, it will be noticed that transverse forces exerted on the chock typified by the arrow A in FIG. 3 are transmitted, not to fasteners 53 and 53*a*, but to the sleeves 36 and thence to the slider 16 and track T. This lack of stress of the screws translates directly to an ability of the chock to take physical abuse without such damages as will impair its function.

The strap 12 which is typically formed of stainless steel tubing has flattened double walled ends 50*a* for strength. Its mid portion 50 partially flattened forming a hollow, pillow shaped structure which is very resistant to upward bending forces exerted by, say, line L in FIG. 1. That structure also presents a very smooth rounded surface to line L so that it does not tend to abrade or chafe the line. Strap 12 is conveniently formed by a suitable heavy duty press. The inside diameter and wall thickness of the strap tubing will, of course, vary depending upon the size of the chock.

With its superior strength and versitility, the subject adjustable roller chock should be a useful item of marine hardware.

It is to be understood that the following claims are intended to cover all of the generic and specific features of the invention herein described and all statements of the scope of the invention which might be said to fall therebetween.

What is claimed is:

1. In a roller chock of the type comprising a base including a slider and locking means adapted to tighten said slider onto a slide track, two spaced-apart rollers mounted on said base and a restraining strap fastened to and extending from one roller to the other roller at an opposite end of said rollers from said base, the improvement wherein said strap member is formed of a rigid tube flattened to form flanges at the extremities thereof and partially flattened at a mid-section of said strap to present smooth, rounded surfaces to a line extending under said strap between said rollers and wherein said rollers are rotatively mounted on sleeves projecting up from said slider and further including threaded fasteners turned down into said sleeves to rotatively retain the rollers on the sleeves and wherein said locking means extends through one of said threaded fasteners.

2. An adjustable roller chock comprising a slider for movable engagement in a slide; a pair of internally threaded sleeves secured endwise to the slider at spaced-apart locations thereon; a pair of rollers rotatively positioned on the sleeves; means for retaining the rollers on the sleeves, said means including a pair of threaded headed fasteners turned down into said pair of sleeves, one of said fasteners being in the form of an internally threaded bushing, and locking means movably mounted on said bushing so that a portion thereof can be brought to bear against a slide in which the slider is engaged thereby to permit the slider to be locked at a selected location along the slide said roller chock having line retainer means bridging the rollers.

3. The roller chock defined in claim 2 where the line retainer means is generally of tubular configuration and bridges the space between the pair of rollers and is secured in position at the free ends of said sleeves by said pair of fasteners.

* * * * *